United States Patent [19]

Palitz, Jr.

[11] Patent Number: 4,872,852

[45] Date of Patent: Oct. 10, 1989

[54] CHILD RESISTANT ELECTRICAL SOCKET OR SOCKET ATTACHMENT

[76] Inventor: Bernard G. Palitz, Jr., R.F.D. 4, 431 Haines Rd., Mount Kisco, N.Y. 10549

[21] Appl. No.: 290,482

[22] Filed: Dec. 23, 1988

[51] Int. Cl.[4] ..... H01R 17/04; H01R 33/97

[52] U.S. Cl. ..... 439/307; 439/667

[58] Field of Search ..... 439/611, 613–615, 439/666, 667, 701, 306, 307, 309

[56] References Cited

U.S. PATENT DOCUMENTS

| | | | |
|---|---|---|---|
| 764,829 | 7/1904 | Scott | 439/307 |
| 861,343 | 7/1907 | Wood | 439/307 |
| 897,805 | 9/1908 | Wegner | 439/257 |
| 1,021,179 | 3/1912 | Blake | 439/307 |
| 1,135,206 | 4/1915 | Sachs | 439/255 |
| 1,231,758 | 7/1917 | Lieber | 439/254 |
| 1,262,936 | 4/1918 | Fowler | 313/318 |
| 1,640,189 | 8/1927 | Hamiel | 439/257 |
| 1,721,365 | 7/1929 | Zwetsch | 439/253 |
| 1,780,832 | 11/1930 | McAdams et al. | 439/253 |
| 1,928,657 | 10/1933 | Wolfe | 173/358 |
| 2,071,769 | 2/1937 | Schlicker et al. | 173/328 |
| 2,191,336 | 2/1940 | Carroll | 173/358 |
| 2,372,266 | 3/1945 | Frank | 176/32 |
| 2,494,755 | 1/1950 | Grover | 173/358 |
| 3,056,941 | 10/1962 | Eriksson | 339/72 |
| 3,165,370 | 1/1965 | Laub, Sr. | 339/73 |
| 3,215,972 | 11/1965 | Eriksson | 339/72 |
| 3,504,329 | 3/1970 | Peterson et al. | 339/73 |

*Primary Examiner*—Gary F. Paumen

*Attorney, Agent, or Firm*—Pennie & Edmonds

[57] ABSTRACT

A child resistant electrical light socket for resisting removal of a threaded base of a light bulb therefrom comprising an outer portion having an opening to receive the bulb and a pair of electrical contacts, an inner rotatable sleeve with mating threads and means for securing the inner sleeve. Also, a child resistant attachment for a standard threaded light socket to resist the removal of a bulb therefrom comprising a lower threaded sleeve, a base portion having an electrical contact, a mounting portion and an upper rotatable sleeve with threads for engaging the threads of a bulb. The apparatus also comprises means for securing the upper sleeve. In addition, a second child resistant attachment for a standard light socket comprising an outer threaded sleeve, a mounting collar, an inner rotatable threaded sleeve and ratchet teeth to secure the inner sleeve.

6 Claims, 5 Drawing Sheets

CHILD RESISTANT ELECTRICAL SOCKET OR SOCKET ATTACHMENT

TECHNICAL FIELD

This invention relates to an electrical light socket and more particularly to a child resistant mechanism for screw-in light sockets which prevents the unscrewing of the bulb by small children.

BACKGROUND ART

The present invention is directed to a safety feature for screw-in light sockets which provides a high degree of protection against a small child removing the bulb and receiving an electric shock. The design is such that only a knowledgeable adult may remove the bulb in a quick and easy manner.

Various light bulbs or bulb connectors have been developed which simplify the installation and removal of the bulb. Typical examples of such bulbs or bulb connectors can be found in U.S. Pat. Nos. 2,372,266 (lamp plug); 3,056,941 (connector) and 3,215,972 (connector). Each of these references substitute a spring type or spring-loaded means in place of the standard screw threads which allow the bulb to be introduced and withdrawn from a socket without rotation.

Similarly, various sockets have also been developed which allow the bulb to be installed or removed without rotation. Typical examples of these can be found in U.S. Pat. Nos. 2,494,755, 3,165,370 and 3,504,329. Once again, the object of these devices is to eliminate the relative screw action from the installation and removal of a light bulb.

Each of these prior art devices exhibit means which enhance the ease with which a light bulb can be installed or removed instead of the child resistant locking mechanism of the current invention. Furthermore, these devices seek to eliminate the need for screw threads either on the bulb or in the socket.

SUMMARY OF THE INVENTION

The present invention relates to a child resistant mechanism for screw-in light sockets comprising an inner sleeve having recesses or indentations and an outer cylindrical portion having means for engaging these recesses. The inner sleeve and the outer portion are jointly configured to mate and securely lock the inner sleeve in position so that a bulb can be installed or removed. When these means are not engaged the inner sleeve will spin freely as the bulb is rotated.

The outer cylindrical portion of the mechanism is formed of any suitable insulating material. This portion is equipped with an open upper end for receiving a light bulb and a pair of electrical contacts. Rotatably mounted within this cylindrical portion is the inner sleeve which is a thin cylindrical sleeve of conductive material having standard threads to engage the bulb. The inner sleeve is further equipped with at least one, and preferably two, recesses along its outer wall and is connected to the base of the outer portion via a slideable electrical connection. The socket further comprises means for securing the inner sleeve and external means to retract the securing means.

In the preferred embodiment the inner sleeve is provided with a pair of diametrically opposite recesses. The securing means may be at least one member threaded or protruding through a radial aperture in the outer cylindrical portion which engages an inner sleeve recess. Preferably there are two of these members which are coincident with the inner sleeve recesses. These members may be supplied with outwardly biased springs.

An alternate embodiment of the invention relates to a child resistant attachment for a standard threaded light socket comprising a lower sleeve having standard screw threads to engage the socket, a non-conductive base within the lower sleeve and an electrical contact element within the base to provide an electrical path from the socket to a bulb. This embodiment further comprises an outer cylindrical portion for mounting the apparatus, an upper sleeve rotatably mounted within the outer portion and means for securing the upper sleeve. In the preferred embodiment, the securing means comprises a pair of diametrically opposite members which project inwardly through the outer portion and engage recesses in the upper sleeve. These members be supplied with outwardly biased springs. Also, the apparatus has a means for retracting these members.

A further embodiment of the invention relates to another child resistant attachment for a standard threaded light socket. This embodiment comprises a casing, means for mounting the apparatus to the socket and means for engaging a screw-in light bulb. In the preferred embodiment, the casing is an outer sleeve having standard external threads for engaging the socket threads and the bulb engaging means is an inner sleeve rotatably mounted within the outer sleeve having internal threads for engaging the threads of the bulb. The apparatus is further provided with cooperating ratchet teeth on the mounting means and inner sleeve to facilitate removal of the bulb.

These child resistant sockets or socket attachments can easily be adapted for a wide range of uses. By altering the size and shape of these inventions, they can be configured for use in any socket requiring child proofing such as Christmas or novelty lights, standard lamps, wall mounted sockets, plugs, fuses or the like.

BRIEF DESCRIPTION OF THE DRAWINGS

Further benefits and advantages of the invention will become apparent from a consideration of the following description given with reference to the accompanying figures which specify and show preferred embodiments of the invention, and wherein.

DETAILED DESCRIPTION OF THE PREFERRED EMBODIMENT

Figure 1:
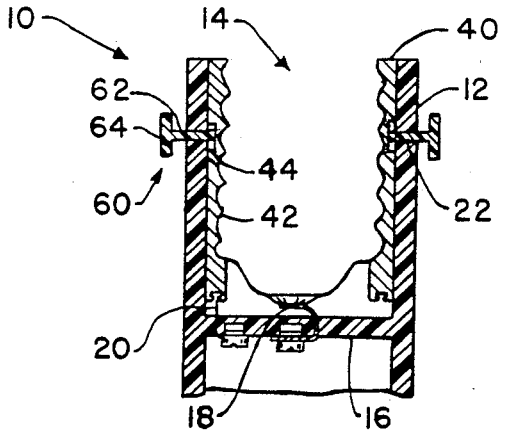
FIG. 1 is a sectional view of the threaded base of the socket in the present invention taken along a vertical plane through its center.
Figure 2:
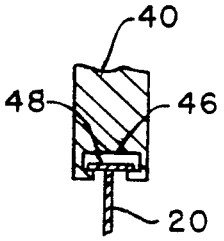
FIG. 2 is an enlarged sectional view of the slideable electrical connection to the inner sleeve of FIG. 1.
Figure 3:
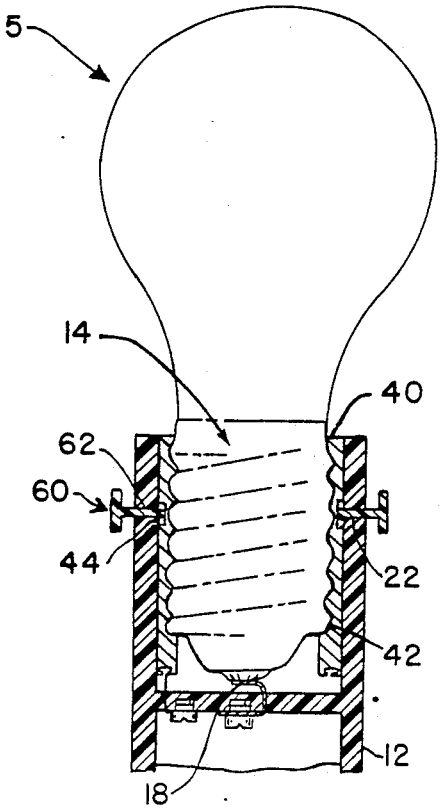
FIG. 3 is a sectional view similar to FIG. 1 showing a standard screw-in light bulb installed in the present invention.

Referring now to FIGS. 1, 2 and 3 there is illustrated a child resistant electrical light socket generally designated by the numeral 10. The socket 10 comprises an outer cylindrical portion 12, an inner sleeve 40, and a securing and retracting means 60.

The outer cylindrical portion 12 is formed of a suitable insulating material and has an open upper end 14 for receiving a standard light bulb, a base 16 and a pair of electrical contact elements 18 and 20. The outer portion further comprises apertures 22 which are diametrically opposite and located in the upper region of its sidewall for introduction of the securing and retracting means 60.

Rotatably mounted within cylindrical portion 12 is a thin cylindrical sleeve 40 of conductive material. Sleeve 40 has standard internal screw threads 42 which are designed to mate with the threads of an ordinary light bulb 5. The outer wall of sleeve 40 has recesses 44 in its sidewall which coincide with apertures 22 in cylindrical portion 12. Sleeve 40 also has a channel shaped annular groove 46 around its lowermost perimeter.

Electrical contact element 18 is attached to the center contact in base 16 of socket 10. Contact element 20 has a support element 48 which sits in groove 46 to form a sliding electric contact with sleeve 42 such that sleeve 42 can rotate completely around while in electrical contact.

Located within apertures 22 of cylindrical portion 12 are securing and retracting means 60. Means 60 comprises two diametrically opposite fingers 62 that extend through apertures 22 of cylindrical portion 12 and engage recesses 44 of sleeve 40 when the sleeve is secured. Caps 64 on fingers 62 are designed to be easily grasped between the thumb and forefinger to enable one to retract the fingers.

To install a light bulb in socket 10, caps 64 of members 60 are pushed in urging fingers 62 toward the interior of the socket 10. Fingers 62 engage recesses 44 of inner sleeve 40 thereby securing the sleeve 40 in position and preventing any rotation. Bulb 5 is then introduced into inner sleeve 40 by means of opening 14 and screwed into the socket in the usual manner. Upon installation, caps 64 of members 60 are pulled out causing fingers 62 to disengage from recesses 44 of inner sleeve 40 as shown in FIG. 3. Inner sleeve 40 now rotates freely within outer portion 12 so that any unscrewing motion applied to bulb 5 will cause bulb 5 and inner sleeve 40 to rotate jointly thereby preventing removal of the bulb.

In order to remove bulb 5, caps 64 of members 60 are again pushed in causing fingers 62 to engage recesses 44 thereby securing inner sleeve 40. Bulb 5 is then removed by unscrewing it.

Figure 4:
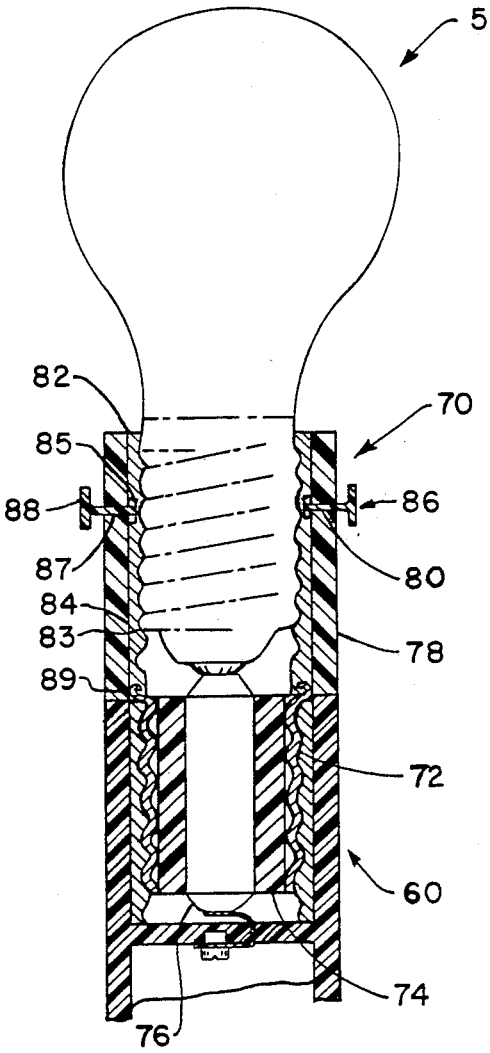
FIG. 4 is a sectional view of an alternate embodiment of the invention attached to a standard light socket with a bulb installed.

Referring now to FIG. 4 there is illustrated a child resistant attachment for a standard electrical light socket 60 which is similar to the apparatus described above and designated by the numeral 70. Apparatus 70 comprises a lower sleeve 72 which is screwed into conventional socket 60 and a cylindrical portion 74, a contact element 76, an outer cylindrical portion 78, an inner sleeve 82, and a securing means and retracting means 86.

Lower sleeve 72 of attachment 70 is a thin cylindrical sleeve of conductive material having external threads designed to mate with the threads of an ordinary socket 60. A cylindrical base portion 74 of non-conductive material having a contact element 76 is securely mounted within lower sleeve 72. Contact element 76 extends axially along the length of cylindrical base portion 74 and protrudes beyond its uppermost and lowermost boundaries to provide an electrical path from the base of the socket to a bulb 5.

Outer cylindrical portion 78 of apparatus 70 is constructed of a suitable insulating material and acts as as mounting means. In addition, outer cylindrical portion 78 comprises apertures 80 which are diametrically opposite and located in the upper region of its sidewall for introduction of securing and retaining means 86. Lower sleeve 72 and cylindrical portion 78 are firmly attached by an adhesive or any other means suitable to prevent any relative movement.

A thin upper sleeve 82 of conductive material having standard internal screw threads 83 to engage the threads of an ordinary bulb is rotatably mounted to lower sleeve 72 and outer cylindrical portion 78. Lower sleeve 72 and upper sleeve 82 are mechanically and electrically connected by a slideable electrical contact in the form of interlocking lips 89, thus placing the upper sleeve 82 in electrical connection with the socket. Outer wall 84 of upper sleeve 82 is provided with recesses 85 which coincide with apertures 80 of outer cylindrical portion 78.

Securing and retaining means 86 are located within apertures 80 of outer cylindrical portion 78 and comprises fingers 87 and caps 88. Fingers 87 and caps 88 are substantially similar in construction and function to fingers 62 and caps 64.

Attachment 70 is attached to a standard screw-in light socket 60 by inserting lower sleeve 72 into the socket, engaging its external threads with the internal threads of the socket and rotating attachment 70 until contact element 76 firmly abuts the electrical contact at the base of the socket.

The installation procedure of a bulb in this apparatus is similar to the previous embodiment where caps 88 are pushed in urging fingers 87 to engage recesses 85 thereby securing upper sleeve 82. Bulb 5 is introduced into upper sleeve 82 and screwed into attachment 70 in the usual manner until solid connection is made with the uppermost portion of contact element 76. Caps 88 are then pulled outward causing fingers 87 to disengage from recesses 85 of upper sleeve 82 thereby allowing sleeve 82 to rotate freely. To remove bulb 5, caps 88 are pushed in so that fingers 87 are thrust into recesses 85 thereby securing upper sleeve 82 so that bulb 5 is readily unscrewed.

Figure 5:
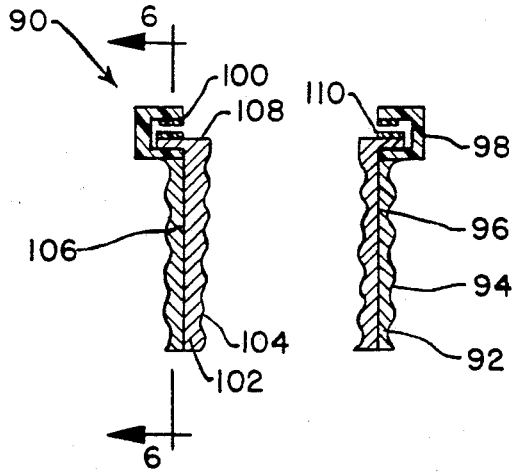
FIG. 5 is a sectional view of another child resistant mechanism for screw-in light sockets.
Figure 6:
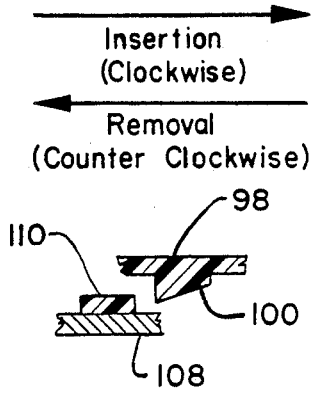
FIG. 6 is an enlarged sectional view of the interlocking teeth in FIG. 5 taken along line 6—6.
Figure 7:
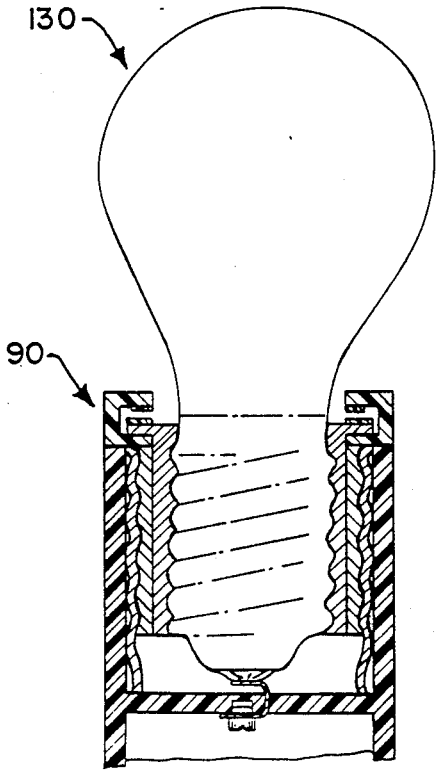
FIG. 7 is a sectional view similar to FIG. 5 showing a screw-in bulb installed in the apparatus.

FIGS. 5, 6 and 7 illustrate another embodiment of a child resistant attachment for a standard electrical light socket depicted by the numeral 90. Attachment 90 comprises an outer sleeve 92, a mounting means 98 and an inner sleeve 102.

Outer sleeve 92 of apparatus 90 is a thin member of conductive material having standard external threads 94 for engaging the threads of an ordinary light socket and a cylindrical inner wall 96. Mounting means 98 is in the form of a channel shaped annular collar of a suitable insulating material which is firmly secured to outer sleeve 92. Mounting means 98 comprises upper and lower parallel flanges integrally formed with a sidewall. The upper flange of collar 98 further comprises interlocking means 100 which are ratchet teeth formed by a plurality of substantially wedge shaped protrusions evenly spaced around its lower surface.

Inner sleeve 102 comprises a conductive material having internal screw threads 104 to engage the threads of a bulb, a cylindrical outer wall 106, which is sized to fit snugly within inner wall 96 of outer sleeve 92 so that the inner sleeve may slide within outer sleeve 92 while maintaining electrical contact, and an upper flange 108 that is rotatably mounted within outer sleeve 92 and collar 98. Upper flange 108 of inner sleeve 102 further comprises interlocking means 110 which are ratchet teeth formed by a plurality of rectangular protrusions evenly spaced around its upper surface.

To install attachment 90, outer sleeve 92 is inserted into the socket so that external threads 94 engage the internal threads of the socket and attachment 90 is rotated until it is fully installed. A bulb 130 is installed in attachment 90 by inserting the threaded portion of the bulb into inner sleeve 102, engaging threads 104 and screwing in bulb 130 in the normal manner. No additional force is required for installation since teeth 100 of collar 98 and teeth 110 of inner sleeve 102 are designed to operatively engage in the direction of rotation associated with the screwing in of bulb 130 as shown in FIG. 6.

When bulb 130 is fully installed, inner sleeve 102 will spin freely in the counter clockwise direction within outer sleeve 92 and collar 98 so that any unscrewing motion applied to bulb 130 causes joint rotation of inner sleeve 102 with the bulb thereby preventing removal of bulb 130 from the socket. In order to remove bulb 130, the upper flange of collar 98 must be supplied with a force in the direction of the base of the socket to engage teeth 100 and teeth 110 while unscrewing bulb 130. When teeth 100 and 110 engage, inner sleeve 102 is prevented from rotation and bulb 130 is easily removed therefrom.

What is claimed is:

1. A child resistant electrical light socket for resisting removal of a threaded base of a standard light bulb therefrom comprising in combination:

(a) an outer cylindrical portion having an open upper end to receive said base of said bulb and a base with a pair of electrical contact elements;

(b) an inner cylindrical sleeve rotatably mounted within said outer portion having standard internal screw threads for receiving the threaded base of said bulb, at least one recess in its outer wall and a slidable electrical connection to one of said base contact elements;

(c) moveable means mounted in the outer cylindrical portion for securing said inner sleeve and preventing rotation thereof by mating with said inner sleeve recess comprising a member projecting inwardly through the sidewall of said outer portion; and (d) means for retracting said inwardly projecting member whereby said inner sleeve rotates freely within said outer portion unless said member engages said recess.

2. The apparatus of claim 1 wherein said inner sleeve has a pair of diametrically opposite recesses.

3. The apparatus of claim 1 wherein said securing means comprises a pin projecting through an aperture in the sidewall of said outer portion.

4. The apparatus of claim 2 wherein said securing means comprises a pair of diametrically opposite radial apertures coincident with said inner sleeve recesses and pins extending through said apertures.

5. The apparatus of claim 4 wherein said pins are threaded through said apertures.

6. A child resistant attachment for a standard threaded light socket to resist removal of a light bulb therefrom comprising:

(a) a lower threaded sleeve for engagement with threads of said socket;

(b) a non-conductive cylindrical base portion securely mounted to said lower sleeve having a conductive electrical contact element extending axially along its length;

(c) an outer cylindrical mounting portion firmly secured to said lower sleeve and having at least one aperture;

(d) an upper sleeve rotatably mounted to said lower sleeve and within said outer cylindrical portion having standard internal screw threads for receiving the threaded base of said bulb and a cylindrical outer wall having at least one recess coincident with said outer portion aperture;

(e) at least one member moveably mounted to said outer cylindrical portion projecting inwardly through said aperture for engaging said upper sleeve recess; and (f) means external to said outer cylindrical portion to retract said inwardly projecting member whereby said upper sleeve rotates freely with respect to said outer portion and said lower sleeve unless said member engages said recess.

* * * * *